United States Patent [19]

Wieland et al.

[11] 4,079,708

[45] Mar. 21, 1978

[54] CONTROL DEVICE FOR THE ENGINE OF AN ENGINE DRIVEN SAW

[75] Inventors: Dieter Wieland, Neckarrems; Klaus Höppner, Marbach, both of Germany

[73] Assignee: Andreas Stihl Maschinenfabrik, Neustadt, Germany

[21] Appl. No.: 663,157

[22] Filed: Mar. 2, 1976

[30] Foreign Application Priority Data

Mar. 5, 1975 Germany ..... 2509443

[51] Int. Cl.[2] ..... F02D 11/02

[52] U.S. Cl. ..... 123/98; 123/179 C; 123/198 DC; 261/52

[58] Field of Search ..... 123/98, 119 F, 179 A, 123/179 B, 179 BG, 179 C, 179 G, 198 DC; 74/513; 261/52

[56] References Cited

U.S. PATENT DOCUMENTS

| | | | |
|---|---|---|---|
| 2,873,731 | 2/1959 | Richardson | 123/98 X |
| 2,908,263 | 10/1959 | Brown | 123/98 |

*Primary Examiner*—Carlton R. Croyle
*Assistant Examiner*—Michael Koczo, Jr.
*Attorney, Agent, or Firm*—Walter Becker

[57] ABSTRACT

A control device for the engine of an engine driven saw having a carburetor with a normally closed fuel control or throttle valve and a normally open starting or choke valve. The device includes a selector member which has a "stop" position in which the engine ignition is disabled and an "operating" position in which the throttle valve is freely adjustable. The selector member also has a "warm start" position and a "cold start" position with the throttle valve being held in a position of minimum opening thereby in each position while the starting valve is held closed by the selector member only in the "cold start" position of the selector member.

20 Claims, 6 Drawing Figures

CONTROL DEVICE FOR THE ENGINE OF AN ENGINE DRIVEN SAW

The present invention relates to a hand saw driven by an internal combustion engine, and in particular concerns a motor chain saw in which the output of the machine is adjustable by means of a gas pedal with an associated gas lever blocking device which acts upon a control member that is formed in particular by a throttle flap which is continuously urged in the direction toward its closing position. The invention relates in particular to a saw of the above mentioned type in which the throttle flap has associated therewith as adjustable starting positions at least one starting position for the hot start and one for the cold start as well as an idling position of operation, to which the throttle flap can be moved from its hot start position by an adjustment in opening direction and elimination of the starting adjusting position, and in which there is provided a starter flap adjustable for the cold start and a short circuit position operated when changing over the engine to its stopping position.

With heretofore known motor chain saws, the adjustment of the starting position for hot and cold start, and the adjustment of the stopping position is effected through the intervention of adjusting elements independent of the gas lever and the gas lever block associated therewith. In addition thereto, it is necessary to adjust the starter flap necessary for the cold start operation, independently of the adjustment of the throttle flap position for the starting positions. Thus, in addition to the gas lever and the block associated therewith, there is provided a number of independent further actuating elements with the result that errors in the operation may occur which could have a dangerous effect, particularly when, for instance, in an emergency the short circuit lever is confused with another lever or the operator has to hunt for it. Based on the above mentioned finding, it is an object of the present invention so to improve the motor chain saws of the above mentioned known type that the actuating devices are greatly simplified and that operating errors can be avoided as far as possible.

These and other objects and advantages of the invention will appear more clearly from the following specification in connection with the accompanying drawings, in which.

The object underlying the present invention has been realized according to the invention by the fact that for adjustment of the starting position of the position of operation, and of the stop position, there is provided a single selecting member which becomes effective when actuating the throttle valve flap and by means of which during the adjustment into the cold starting position, the starting flap is adapted to be closed.

This design in which the provided starting positions stop, operation, hot start, and cold start, are carried out by only one selector or selecting member is secured against accidental shifting from operation to the starting position by the fact that due to the cooperation of the selecting member with the actuation for the throttle flap, such shifting over will be possible only when simultaneously the block associated with the gas lever is disengaged through which block the gas lever is secured in its idling position. Due to the combination of the different operating devices, it is additionally possible to place the selector lever in an optimum position and in the vicinity of the gas lever which is naturally not possible when a plurality of such operating elements are provided. Furthermore, the operation is additionally simplified by the fact that in combination with the throttle flap adjustment for the cold start position, simultaneously the starter flap is actuated so that corresponding operating errors will be excluded.

Further, particularly advantageous features of the invention are seen in the fact that while the selector lever can from its hot start position by actuation of the gas lever or pedal be automatically returned to its position of operation, but that in the cold start position, the selector position of the lever remains independent of an actuation of the gas lever in opening direction of the throttle valve flap so that the starter flap in spite of opening the gas throttle in order to warm up the engine faster, a return shifting of the throttle flap will not occur too early. This is particularly advantageous for low outside temperatures. According to a further development of the invention, however, also from the cold start position, an automatic return can be realized by actuation of the gas lever. One-lever controls are known for instance in connection with lawn mowers. For chain saws, such one-lever operations, however, are not suitable because the start position is not blocked by a blocking device against accidental operation, and because also no automatic adjustment of the adjusting lever by opening the gas throttle from the hot start position to the position of operation is provided as is required for safety reasons in connection with chain saws.

Figure 1:
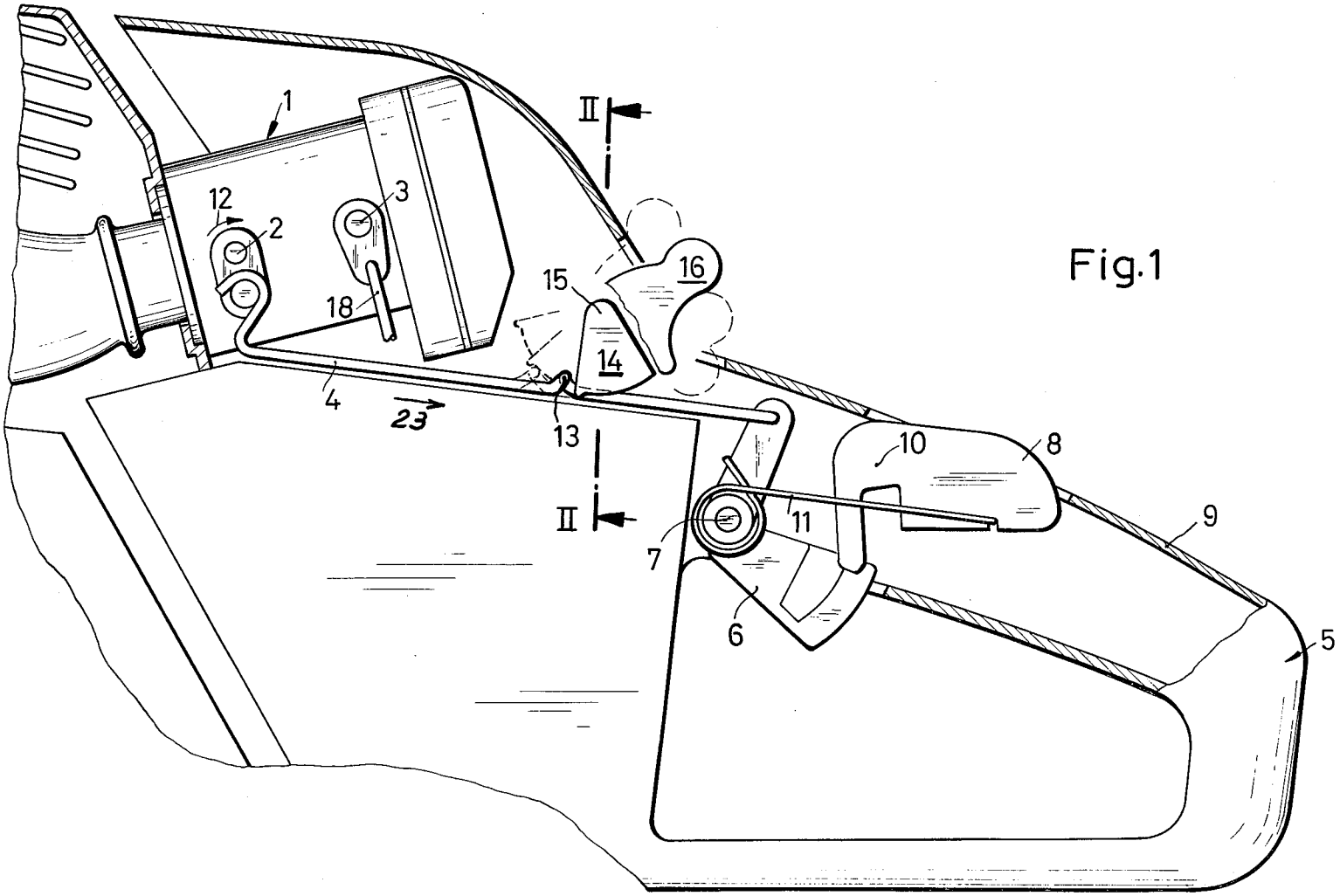
FIG. 1 shows a longitudinal section through the rear portion of a motor chain saw according to the present invention.

Referring now to the drawings in detail, FIG. 1 shows that the only partially illustrated motor chain saw which includes an internal combustion engine as driving engine is supplied through a carburetor 1 with a fuel mixture having associated therewith a throttle flap and a starter flap of which only the respective shafts 2 and 3 are shown. The throttle flap shaft 2 communicates in customary manner with a gas supply controlling linkage 4 which is connected to a gas lever 6 mounted in a handle-forming frame 5. This lever 6 is pivotable about a shaft 7 which is parallel to the throttle flap shaft 2 and starter flap shaft 3, and with which there is associated a gas lever blocking device 8. The arrangement is in customary manner so designed that the gas lever engages the bottom side of the handle part 9 of the handle-forming frame 5. The gas lever blocking device which is pivotable about a shaft 10 substantially parallel to the shaft 7 projects upwardly beyond the handle part 9. Gas lever blocking device 8 and gas lever 2 are respectively by means of a spring 11 urged toward their starting position. The starting position of the gas lever corresponds to a position of operation corresponding to the idling position. From this position of operation, the gas lever can be shifted after depression of the gas lever blocking device 8, only in a direction which corresponds to the opening direction of the throttle flap (see arrow 12).

Figure 2:
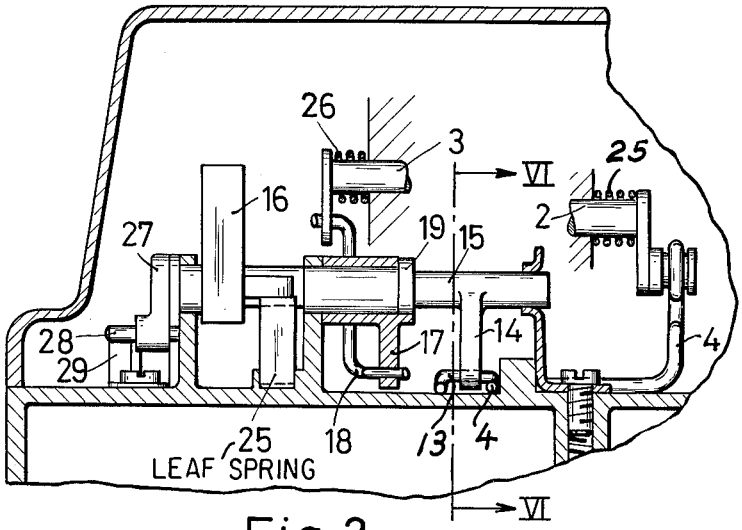
FIG. 2 represents a cross section through the chain saw according to FIG. 1, said section being taken along the line II—II of FIG. 1 while in this illustration sections are included at the level of the longitudinal valve shaft and of the starter flap shaft.
Figure 3:
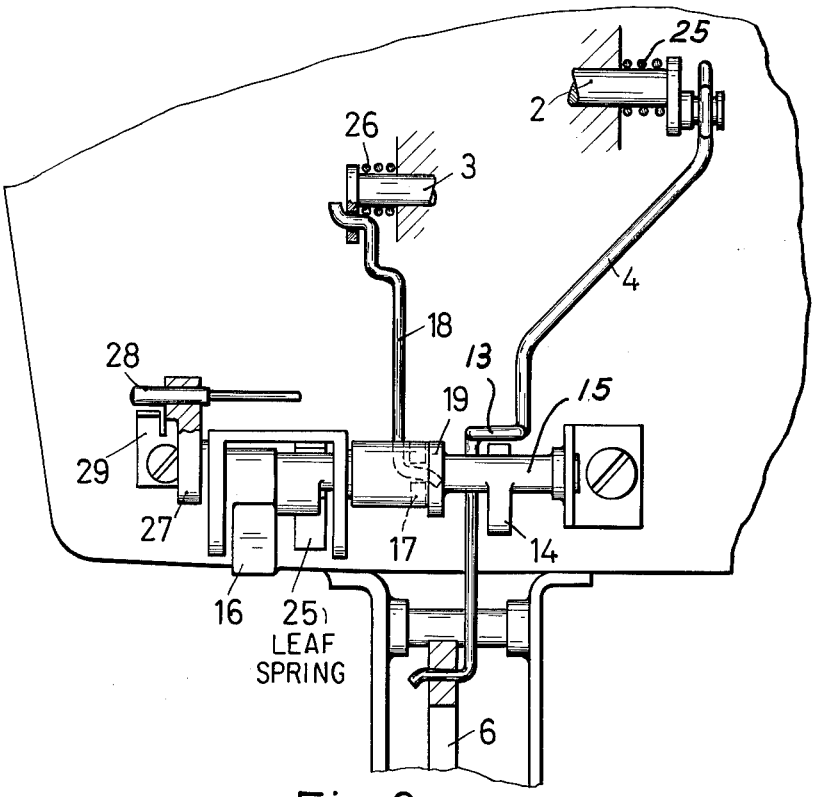
FIG. 3 illustrates a top view in partially a section of the arrangement of FIG. 2.

As will be evident from the drawings in particular of FIGS. 2 and 3, the linkage 4 comprises an angled-off and cranked section 13 in which it cooperates with an adjusting member 14 which, according to the embodiment of FIGS. 2 and 3 is formed by an adjusting lever integral with the shaft 15. The adjusting member 14, the pivot shaft 15 of which is about parallel to the section 13 of the gas lever linkage and also about parallel to the shafts 2 and 7 is, by means of a selecting member 16 shiftable in the form of a selector lever which is non-rotatably connected to the adjusting member. The connection is effected through the intervention of member 15 serving as shaft, on which is mounted a starter lever 17 which is in engagement with the starter linkage 18 and which in response to the turning of shaft 15 is over a certain angle range shifted by a follower 19 associated with said shaft 15.

In contradistinction to the illustrated embodiment, the design may expediently also be modified in such a way that the adjusting member cooperates directly with the gas lever and that the selecting lever simultaneously acts as adjusting lever and cooperates with the gas lever linkage or directly with the gas lever.

The above mentioned shifting range of the starter lever 17 corresponds to the adjusting range of the selecting lever 16 between the hot starting and cold starting positions of the latter.

These two hot starting and cold starting positions form the two last mentioned starting positions with regard to the opening direction of the throttle flap, to which the selecting lever is movable or adjustable. Summarized, in the embodiment there are provided four such adjustable starting positions and, more specifically, so that in a turning direction corresponding to the opening direction of the throttle flap, (see arrow 20) and following each other, the following positions — a stop position, a position of operation corresponding to an idling position, and the already mentioned starting positions, namely the hot starting and cold starting positions.

Figure 6:
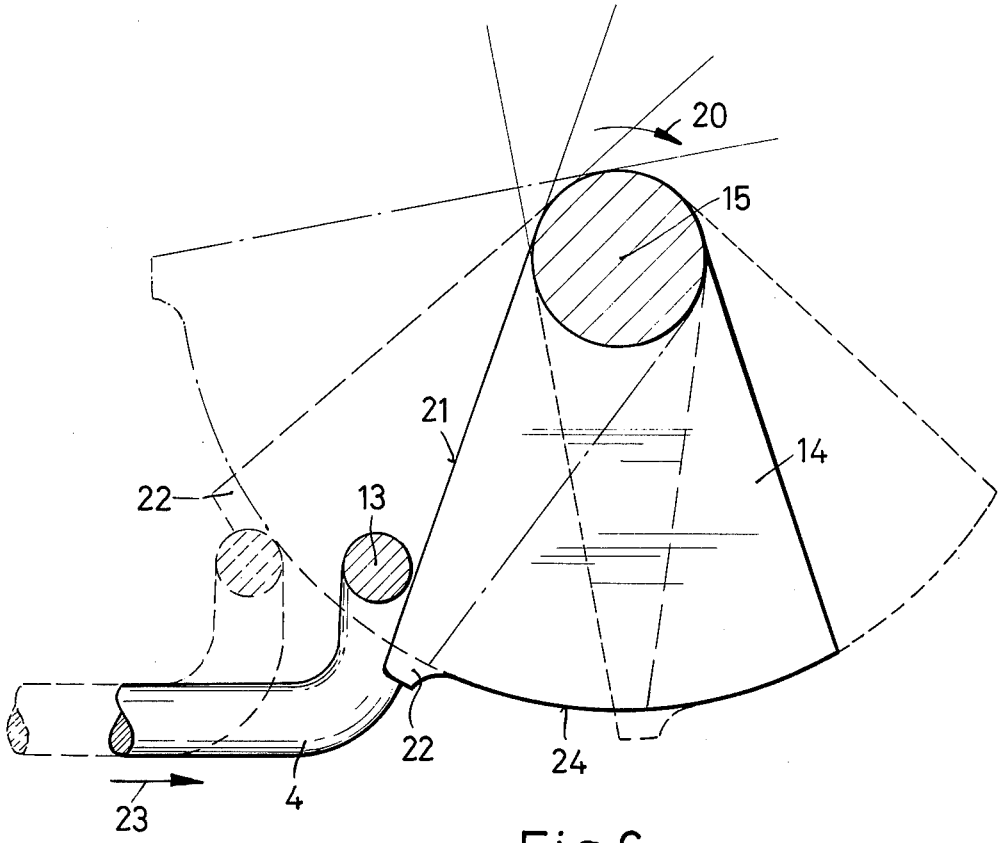
FIG. 6 represents a section taken along the line VI—VI of FIG. 2.

The adjusting lever 14 according to FIGS. 2 and 3 is shown on a larger scale in FIG. 6 and as will be evident, is formed by a circular sector which adjacent to its front edge 21 is with regard to the opening direction of the throttle flap radially outwardly provided with a nose 22.

In combination with FIG. 1, FIG. 6 shows that the gas lever linkage 4 which counter to the opening direction of the throttle flap is spring urged in the direction of the arrow 23, is by means of its section 13 in a position of operation supported through the intervention of the edge 21 of the adjusting lever 14. If lever 14 is shifted from the position of operation in the direction of arrow 20 to the hot start position, the nose 22 slides over the section 13 so that the latter on one hand has its nose 22 and on the other hand has its circumference 24 in engagement with the section 13. In combination with a returning operation effected in the direction of the arrow 23 by the returning spring 25 and the spring load acting upon the linkage 4, the above described partial extension of the lever 14 in hot starting position over the section 13 brings about that said hot starting position can be made ineffective by actuation of the gas lever 6. The reason for this consists in that when actuating the gas lever 6, the gas lever linkage 4 is displaced in a direction opposite to the arrow 23. As a result thereof, the nose 22 is freed, whereby due to the spring load acting on shaft 15, the adjusting lever 14 is automatically returned counter to the direction of the arrow 20 in the direction toward its position of operation. The adjusting lever 14 is urged by the return spring 25 continuously in the direction toward its stopping position.

If, on the other hand, the cold starting position shown in FIG. 6 in dot-dash lines is set, such returning position in the direction toward the position of operation is not obtained for the range between cold starting position and hot starting position. This is due to the fact that the returning spring due to its design and support becomes effective only from the hot starting position on. The result is that in the cold starting position, the throttle flap can by actuating the gas lever 6 be opened further without an automatic change in the setting position for the selecting levers 16, in order for instance by opening the gas throttle to heat up the engine as quickly as possible.

From FIG. 6, it will be seen that with the given sector-shaped design of the adjusting lever 14 for the hot starting position and the cold starting position for the throttle flap, the same opening width is set. This position corresponds to about a half gas position as it is advantageous for the starting operation. By a shift-over of the starting lever 14 from the hot starting position to the cold starting position, however, not only the actuation of the gas linkage 4 in the meaning of a further opening of the throttle flap is freed without thereby bringing about an automatic returning of the adjusting lever 14 to the position of operation in view of the thrust of the spring, but in this connection also through the intervention of a follower 19 arranged on shaft 15, the starting lever 17 is adjusted in closing direction of the starter flap whereby there is obtained the enrichment of the mixture required for the cold starting. The returning of the starter flap to its opening position is effected during the returning of the adjusting lever 14 from its cold starting position automatically by means of the returning spring 26 which in the illustrated embodiment is arranged on the starter flap shaft 3.

In deviation from the illustrated embodiment, it may, with regard to an optimum starting behavior be expedient to select the opening width of the throttle flap for hot starting and cold starting at different magnitudes, in other words, it may be expedient to be able to change the opening width of the throttle flap for hot starting and cold starting, respectively. Furthermore, it may also be advantageous for the cold starting position to provide an automatic returning of the throttle flap occurring in conformity with the actuation of the gas lever.

If the selecting lever 16 serving as selecting member is moved into its stopping position, a short circut lever 27 arranged on shaft 15 is pivoted into a position in which a contact pin 28 arranged on said lever 27 will contact a contact spring 29 connected to mass or ground and will latch into said spring which, however, is not shown in the drawing. As a result thereof, the ignition is short circuited and remains short circuited also when the selector lever is released. Since, similar to the position of operation also in this stop position the gas lever can be actuated only with a simultaneous actuation of the gas lever blocking device 8, an accident adjustment of the selecting lever to one of the starting positions is impossible so that summarized after adjusting lever 16 to the stopping position, absolute assurance is obtained that the engine cannot accidentally be put into operation.

Figure 4:
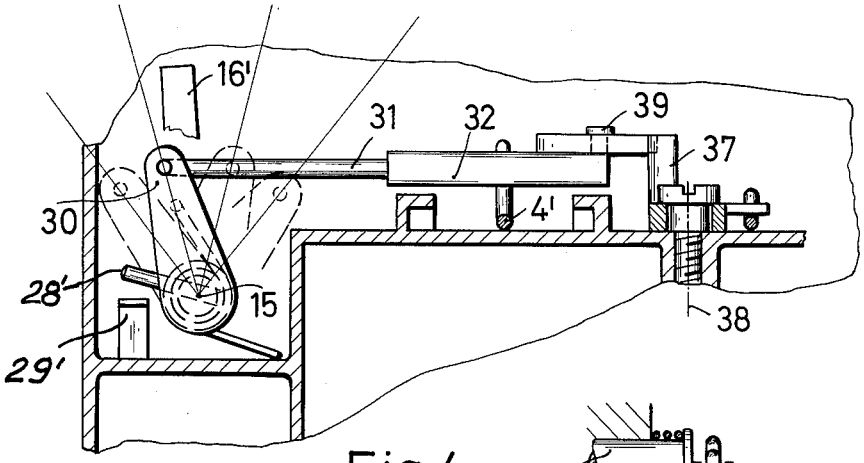
FIG. 4 illustrates similar to that of FIG. 2 a further embodiment of the invention.
Figure 5:
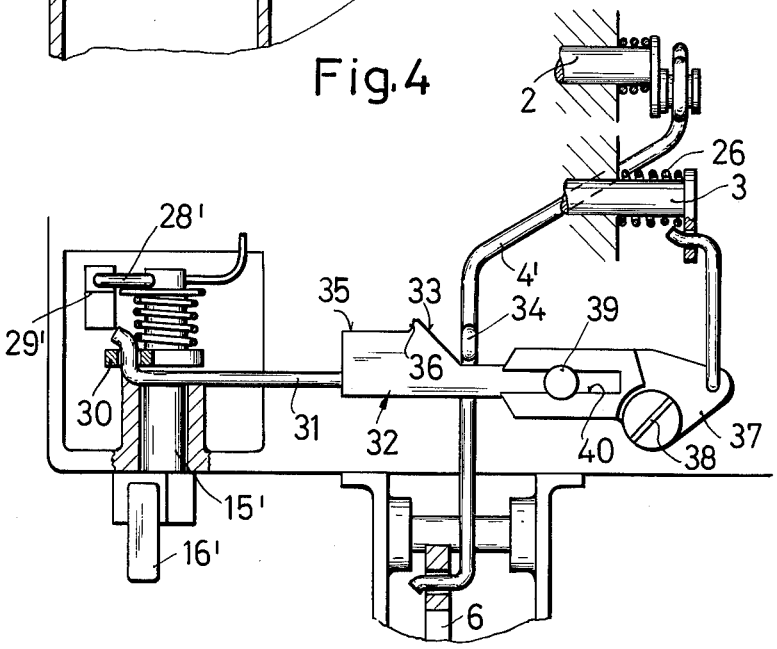
FIG. 5 is a top view of FIG. 4.

FIGS. 4 and 5 show a modification according to which the pivot shaft of selector member and adjusting member do not extend transverse to the displacement direction of the gas lever linkage but extend in about the displacing direction of the gas lever linkage. During a pivoting of the selecting lever 16' which serves as selecting member, it is therefore necessary that the rotary movement for adjusting the gas lever linkage 4' be transformed into a direction of movement which is about perpendicular to the pivoting direction. This is effected according to FIGS. 4 and 5 through the intervention of a pivoting lever 30 which is located on the shaft 15' of the selecting lever 16'. Pivot lever 30 is connected to an actuating rod 31 which in its turn is connected to an adjusting member 32 which is provided with an inclined plane 33. If the selecting lever 16' is pivoted into one of its starting positions, the actuating linkage 31 is displaced toward the gas lever linkage 4' and the inclined plane 33 moves into operative connection with a cam 34 which is formed for instance by a loop of the linkage 4'. As a result thereof, the gas lever linkage 4' is displaced in opening direction of the throttle flap. When the hot starting position has been reached by the angle lever 16', the cam 34 engages the surface 35 which is offset relative to the inclined plane 33 by means of step 36 so that analogous to the above described embodiment, for purposes of pivoting the selecting lever 16' from the hot starting position into the position of operation, the gas lever linkage 4' has first to be displaced in opposite direction of the throttle flap in order to free the adjusting member.

The returning to the position of operation is then effected automatically in view of the spring load which also in this instance prevails in the direction toward the stopping position. FIG. 5 particularly clearly indicates that in conformity with the contour of the surface 35, for the hot starting and cold starting position, the same opening width prevails for the throttle flap. Corresponding to a different angle or setting of the surface 35, it is, of course, also possible in a simple manner to obtain different opening widths for the different starting positions.

As will be evident from FIGS. 4 and 5, with such design, the taking or adjustment of the starting flap when shifting the selecting lever from the hot starting to the cold starting position can be effected in a simple manner through the intervention of an angle lever 37. This lever is pivotable about a shaft 38 which preferably extends at a right angle with regard to the displacement direction of the actuating linkage 31. The lever 37 is provided with a coulisse 40 for a pivot 39 which is associated with the actuating linkage 31 and the adjusting member 32. The length of the coulisse 40 is so dimensioned that the pivot 39 is freely displaceable up to a position which corresponds to the hot starting position and hits an abutment only in the hot starting position in such a way that when shifting from the hot starting position to the cold starting position, the angle lever 37 will be pivoted in closing direction of the starter flap. The starter flap has also in this instance associated therewith a return spring 26 arranged on a shaft 3 so that during the return of the selecting lever 16' from the cold starting position, the starter flap will be opened automatically.

Similar to the embodiments of FIGS. 1-3, shaft 15' has directly associated therewith a contact pin 28' which is stopping positions comes into contact with a contact spring 29' connected to mass or ground, whereby the ignition of the engine is short circuited. Also, in this instance, between said contact spring 29' and the contact pin 28' there is provided a predetermined lock so that the short circuit will be retained also when the selector lever is freed.

By means of the present invention as described above, an actuating device has been created for a motor chain saw in which in response to the actuation of the gas lever, automatically a return from the hot starting position to the position of operation is effected. The arrangement may within the scope of the invention also be so designed that also from the cold starting position an automatic returning position will be provided for instance first only up to the hot starting position when the cold starting position and the hot starting position have different opening widths for the throttle flap.

Furthermore, according to the present invention, the starting positions may from the position of operation be shifted only when simultaneously the gas lever block is depressed so that an accidental starting particularly in connection with the provided arrestable short circuit system in stopping position will be impossible. Due to the fact that the provided starting flap when shifting to the cold starting position is automatically closed, and furthermore due to the fact that according to a preferred embodiment of the invention, the cold starting position independently of the possible actuation of the gas lever linkage system is retained until an intentional returning action is effected, a particularly simple operation and handling of the machine will be assured while the invention is to an optimum extent adaptable to the respectively prevailing temperatures.

The actuating device according to the invention also described above in connection with an exclusively throttle valve controlled engine. However, it is to be understood that a corresponding control can also be employed in connection with another type of output controlled internal combustion engine for instance in connection with internal combustion engines operating with suction pipe injection. Furthermore, the actuating device according to the invention can also advantageously be used when only one starting position is provided.

It is, of course, to be understood that the present invention is, by no means, limited to the specific showing in the drawings, but also comprises any modifications within the scope of the appended claims.

What is claimed is:

1. A control mechanism for an engine driven chain saw having an ignition system and a carburetor with a normally closed throttle flap and a normally open starter flap and with a first linkage connected to the throttle flap and a second linkage connected to the starter flap, said mechanism including a control lever connected to said first linkage, a lock lever and means for operatively connecting the lock lever with the control lever; and a selector member having respective stop, operating, hot start and cold start positions and means for operatively connecting the selector member with said first and second linkages, means for rendering the ignition system inoperative with said selector member in stop position only making the ignition system of the engine inoperative and in the cold start position means for only actuating said second linkage to close said starter flap while holding said first linkage in a position of minimum opening of said throttle flap in both of said hot start and cold start positions, and means for releasing said first and second linkages in said operating position of said selector member.

2. A control mechanism according to claim 1 in which said selector member is adjustable in direction to actuate said first linkage to open said throttle flap when moving away from said stop position and when so moving away from said stop position sequentially moves into said operating position and hot start position and cold start position in succession.

3. A control mechanism according to claim 1 which includes means for holding the said first linkage in the same throttle flap opening position in each of the said hot start and cold start positions of said selector member.

4. A control mechanism according to claim 1 in which said selector member has an element thereon which engages an offset portion on said first linkage in each of the hot start and cold start positions of said selector member.

5. A control mechanism according to claim 1 which includes spring means whereby said selector member is spring biased toward the stop position thereof.

6. A control mechanism according to claim 1 which includes means biasing said first linkage in throttle flap closing direction.

7. A control mechanism according to claim 1 which includes spring means whereby said control lever and locking lever are spring biased toward rest positions thereof.

8. A control mechanism according to claim 4 in which in the operating position of said selector member said element is disposed on the side of said offset portion toward which the offset portion moves when the throttle flap closes.

9. A control mechanism according to claim 4 which includes means whereby said first linkage moving in throttle flap opening direction disengages said offset portion from said element when said selector member is in hot start position or cold start position.

10. A control mechanism according to claim 4 which includes means whereby said element is movable away from the cold start position only by movement of said selector member.

11. A control mechanism according to claim 4 in which said selector member and said element are coaxially supported.

12. A control mechanism according to claim 4 in which said selector member and said element are in the form of respective coaxial levers pivotal on an axis extending at right angles to the direction of movement of said first linkage.

13. A control mechanism according to claim 4 in which said element is in the form of a circular segment coaxial with said selector member and having a radially protruding nose portion at the edge thereof facing the direction in which said first linkage moves in opening said throttle flap.

14. A control mechanism according to claim 12 in which a further lever is connected to said levers to be actuated by movement of said selector member, said further lever being connected to said second linkage and actuating said linkage to close said starting flap as said selector member moves from hot start position into cold start position.

15. A control mechanism according to claim 1 which includes spring means whereby said starter flap is spring biased toward closed position.

16. A control mechanism according to claim 1 which includes means whereby the ignition system of the engine is made inoperative by short circuiting thereof by a pair of normally spaced contacts which become closed in response to movement of said selector member into the stop position thereof.

17. A control mechanism according to claim 16 which includes means whereby said contacts latch in closed position.

18. A control mechanism according to claim 4 in which said element is reciprocable and is in the form of an inclined plane on a member which moves transversely to said first linkage as said selector member is moved and which inclined plane is engageable with said offset portion of said first linkage and is operative to move the linkage in throttle flap opening direction as said selector member moves from the stop position thereof toward the hot start and cold start positions thereof.

19. A control element according to claim 18 in which the upper end of said inclined plane is connected to a surface parallel to the direction of movement of said element and a nose portion formed at the juncture of said plane and surface which is engageable with said offset portion of said first linkage to predetermine the minimum opening position of said throttle flap in the hot start and cold start positions of said selector member.

20. A control element according to claim 18 which includes means connecting said element to said second linkage for movement of said second linkage in starting flap opening direction only during movement of said selector member from hot start position toward cold start position.

* * * * *